US005303568A

United States Patent [19]

Wightman

[11] Patent Number: 5,303,568

[45] Date of Patent: Apr. 19, 1994

[54] PADLOCK PROTECTOR

[76] Inventor: Nate Wightman, Rte. 8, Box 140-E, Lubbock, Tex. 79407

[21] Appl. No.: 987,450

[22] Filed: Dec. 7, 1992

[51] Int. Cl.[5] ..... E05B 67/38

[52] U.S. Cl. ..... 70/56; 70/54; 70/455

[58] Field of Search ..... 70/50, 51, 54, 55, 56, 70/417, 427, 455

[56] References Cited

U.S. PATENT DOCUMENTS

| | | | |
|---|---|---|---|
| 1,291,993 | 1/1919 | Matthews | 70/55 |
| 3,783,657 | 1/1974 | Foote | 70/54 |
| 4,033,155 | 7/1977 | De Lucia | 70/56 |
| 4,095,828 | 6/1978 | East | 70/514 |
| 4,534,190 | 8/1985 | Stanich | 70/54 |
| 4,905,486 | 3/1990 | Appelbaum | 70/55 |
| 5,099,663 | 3/1992 | Dearstine | 70/417 |
| 5,146,771 | 9/1992 | Loughlin | 70/417 |

FOREIGN PATENT DOCUMENTS

| | | | |
|---|---|---|---|
| 338405 | 8/1920 | Fed. Rep. of Germany | 70/55 |
| 326871 | 10/1920 | Fed. Rep. of Germany | 70/50 |
| 344118 | 11/1921 | Fed. Rep. of Germany | 70/55 |
| 57114 | 12/1957 | Italy | 70/39 |
| 8264 | of 1901 | United Kingdom | 70/54 |

*Primary Examiner*—Peter M. Cuomo
*Assistant Examiner*—Darnell M. Boucher
*Attorney, Agent, or Firm*—S. Michael Bender

[57] ABSTRACT

A padlock protector which prevents the shackles of the padlock from being cut by bolt cutters. In its simplest form, the protector is a U-shaped device which contains access openings for the padlock shackles on the bottom and having front and back sections which cover the vertical shafts of the shackles while still allowing room for the padlock to fit through the opening of the device to be secured. In a more elaborate alternatively preferred form, the protector, in addition to the above, contains a front section which extends from the top of the padlock to the bottom of the padlock, a lower section which provides access to the keyhole and protection to the keyhole, and a tough flexible strap connecting the lower section of the protector to a padlock shackle.

6 Claims, 4 Drawing Sheets

PADLOCK PROTECTOR

BACKGROUND OF THE INVENTION

1. Field of the Invention

The present invention relates generally to padlock protectors and more particularly, to padlock protectors which prevent the shackles from being cut with bolt cutters.

2. Description of the Prior Art

It has long been recognized that possessions may be protected by the use of padlocks. U.S. Pat. Nos. 4,987,753 and 4,955,932 disclose padlocks suitable for this use. It has also been recognized that ordinary padlocks do not offer complete security. For this reason more secure padlocks have been developed in which the casing is tough and protects against tampering. U.S. Pat. Nos. 4,899,560 and 4,918,950 are representative of this type of lock. All of the above padlocks suffer from the weakness that the shackles may be cut with bolt cutters. The padlock shown in U.S. Pat. No. 4,953,371 eliminates this possibility by eliminating the shackles. This padlock is complicated in design and, of course, offers no way of protecting the multitude of conventional padlocks already in use.

Thus, while the foregoing body of prior art indicates it to be well known that ordinary padlocks fail to offer satisfactory protection against thieves, there is no teaching in the prior art that conventional padlocks may be provided with protection against bolt cutters. This advantage is provided by the unique padlock protector of the present invention as will be made apparent from the following description. Other advantages of the present invention over the prior art also will be rendered evident.

SUMMARY OF THE INVENTION

To achieve the foregoing and other advantages, the present invention, briefly described, provides a padlock protector which protects the shackles of padlocks from being cut by bolt cutters. This is achieved by providing shields in front of and behind the shackles to prevent the insertion of the bolt cutter blades. A padlock protector thus is provided which prevents the shackles of the padlock from being cut by bolt cutters. In its simplest form, the protector is a U-shaped device which contains access openings for the padlock shackles on the bottom and having front and back sections which cover the vertical shafts of the shackles while still allowing room for the padlock to fit through the opening of the device to be secured. In a more elaborate alternatively preferred form, the protector, in addition to the above, contains a front section which extends from the top of the padlock to the bottom of the padlock, a lower section which provides access to the keyhole and protection to the keyhole, and a tough flexible strap connecting the lower section of the protector to a padlock shackle.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting. As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved padlock protector which has all of the advantages of the prior art and none of the disadvantages.

It is another object of the present invention to provide a new and improved padlock protector which may be easily and efficiently manufactured and marketed.

It is a further objective of the present invention to provide a new and improved padlock protector which is of durable and reliable construction.

An even further object of the present invention is to provide a new and improved padlock protector which is susceptible of a low cost of manufacture with regard to both materials and labor, and which accordingly is then susceptible of low prices of sale to the consuming public, thereby making such padlock protector available to the buying public.

Still yet a further object of the present invention is to provide a new and improved padlock protector.

It is still a further object of the present invention is to provide a new and improved padlock protector which protects the keyhole from the elements.

Still a further object of the present invention is to provide a new and improved padlock protector which may be conveniently stored when not in use.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENTS

Figure 1:
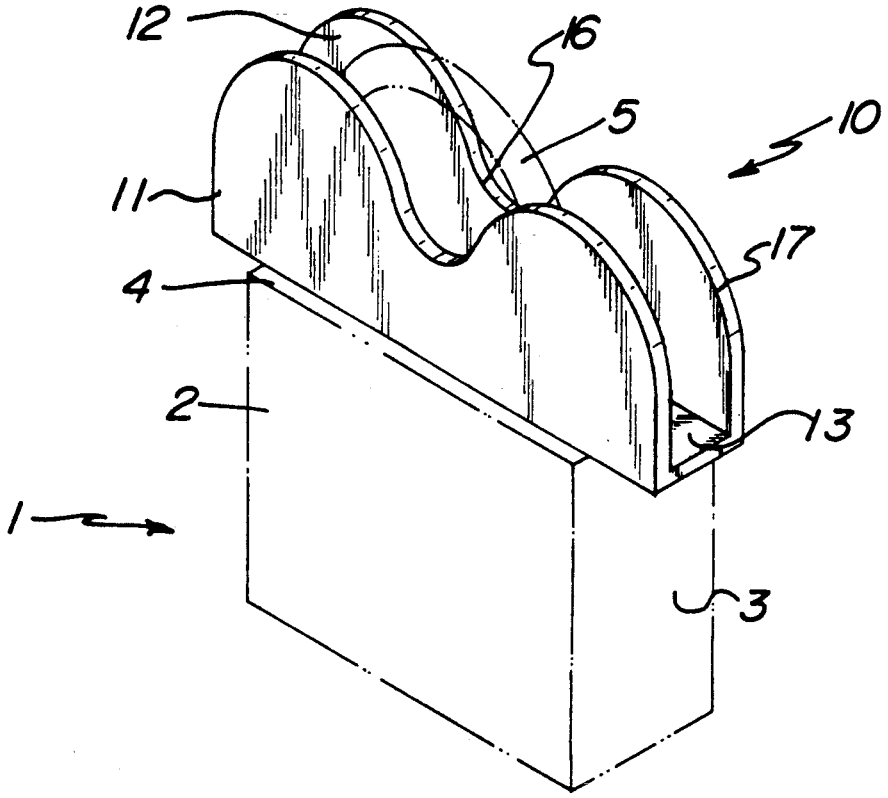
FIG. 1 is an elevational view in perspective showing the first preferred embodiment of the padlock protector of the invention.
Figure 2:
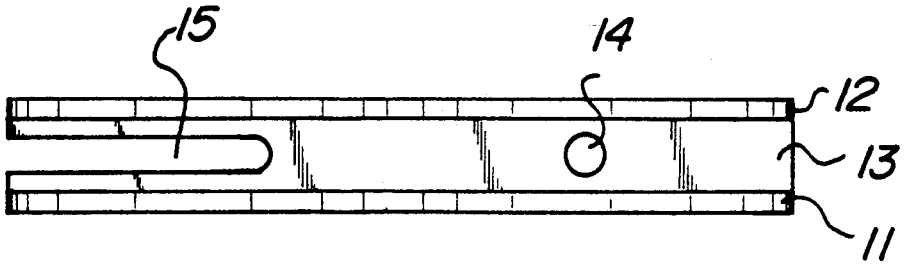
FIG. 2 is a top elevational view of the first preferred embodiment of the padlock protector of the invention.

Turning to FIGS. 1 and 2, the first preferred embodiment is described in detail. The padlock 1 to be protected is shown as having a front 2, a side 3, a top 4, and a shackle 5. The curved portion of the shackle is visible in the Figure. The two vertical shafts cannot be seen. In the conventional padlock, upon opening the lock, one vertical shaft remains fixed to the body of the padlock while the other vertical shaft clears the body to allow for rotational movement between the padlock body and the shackle. The padlock 1 also has a keyhole on the bottom thereof, which is not visible in the Figure.

In accordance with the invention, the padlock protector 10 comprises a front 11, a back 12 and a bottom 13. The bottom 13 contains a hole 14 and a slot 15 along the centerline of the bottom 13 with the slot extending from the left side of bottom 13 toward hole 14 substantially as shown.

In use, the padlock protector is slid over the shackle of a padlock with the latter's fixed vertical shaft received in slot 15. The shackle is then depressed into its locked position with moveable vertical shaft being inserted into the hole 14. This simple maneuver attaches the padlock protector 10 to the padlock 1. Front 11 and back 12 of the padlock protector 10 have a low central area 16 which allows for the space necessary for attachment between the shackle 5 and a latch (not shown). Front 11 and back 12 also have raised lateral areas 17 which serve to protect the vertical shafts of the padlock 1 against the threat of being cut by bolt cutters. The padlock protector 10 is very simple in design. It may be made from hardened or unhardened steel of approximately one-half inch thickness and may be easily manufactured by punching out the desired pattern and performing the required bending steps. The padlock protector 10 should be of such size that its length is greater than the side-to-side measurement of the padlock 1 to be protected.

Figure 3:
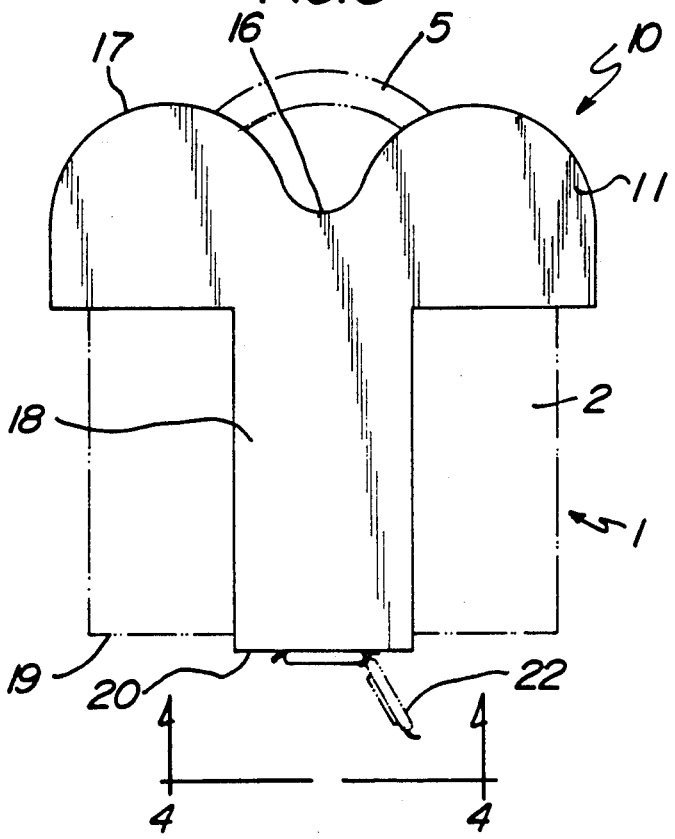
FIG. 3 is a front elevational view of a second preferred embodiment of the padlock protector of this invention.
Figure 4:
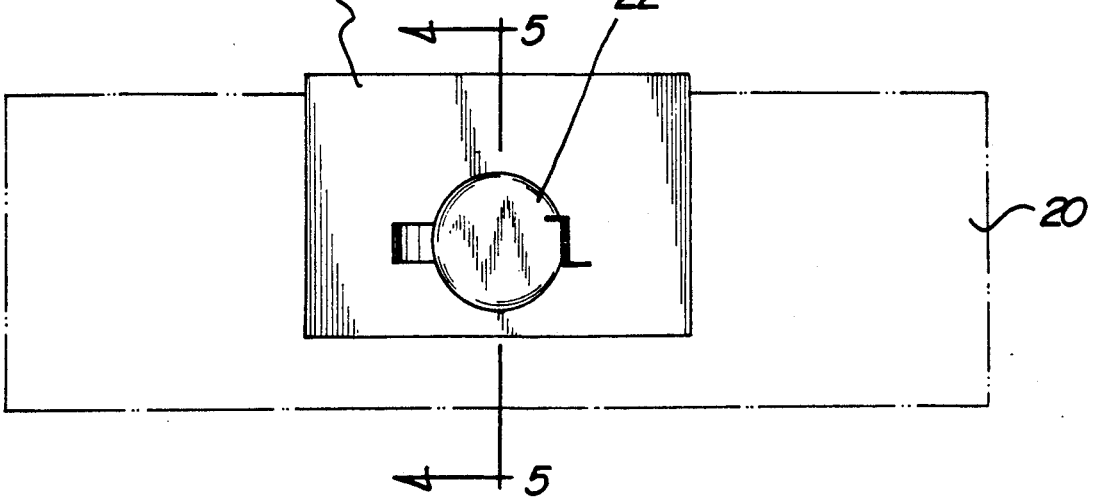
FIG. 4 is a bottom elevational view of the second preferred embodiment of the invention.
Figure 5:
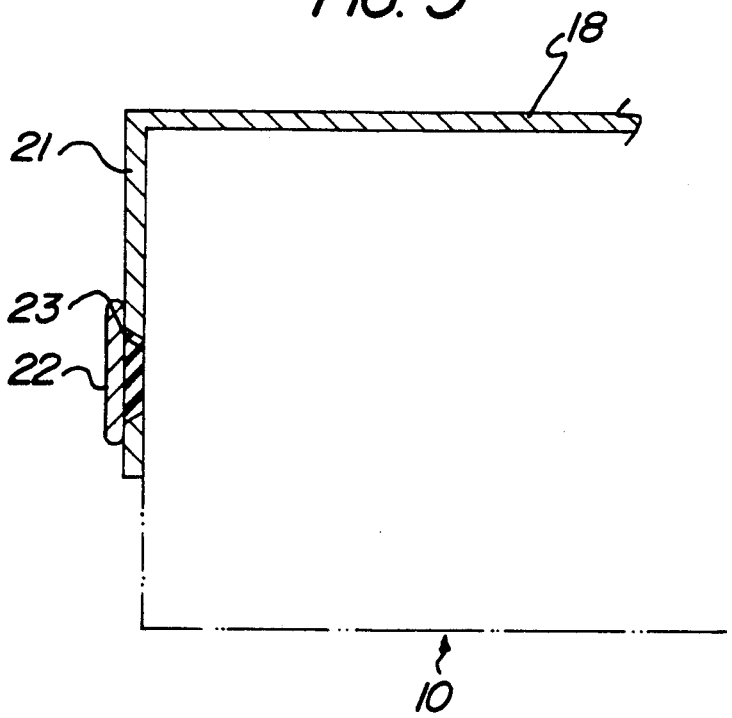
FIG. 5 is a cross-sectional view taken along line 5—5 of FIG. 4.
Figure 6:
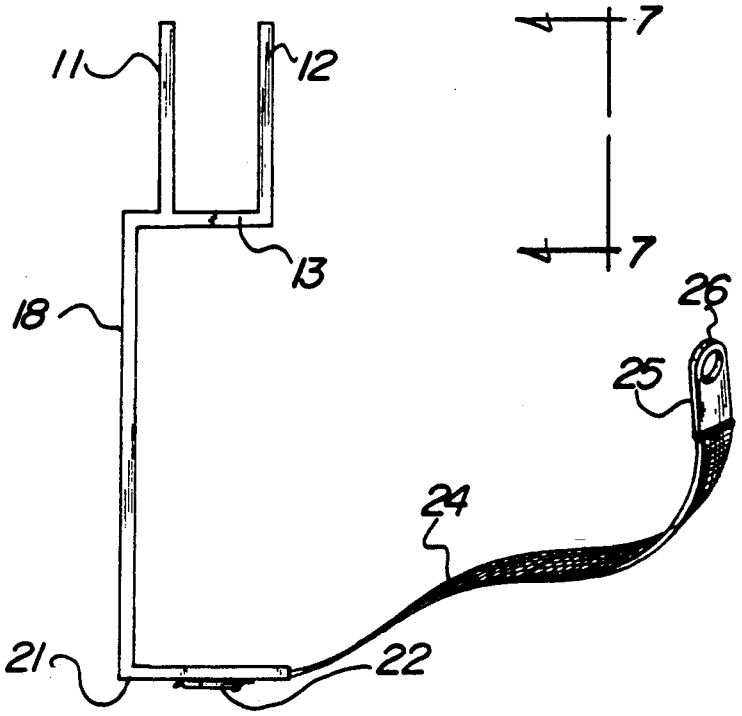
FIG. 6 is a side elevational view of the second preferred embodiment of the padlock protector of the invention.
Figure 7:
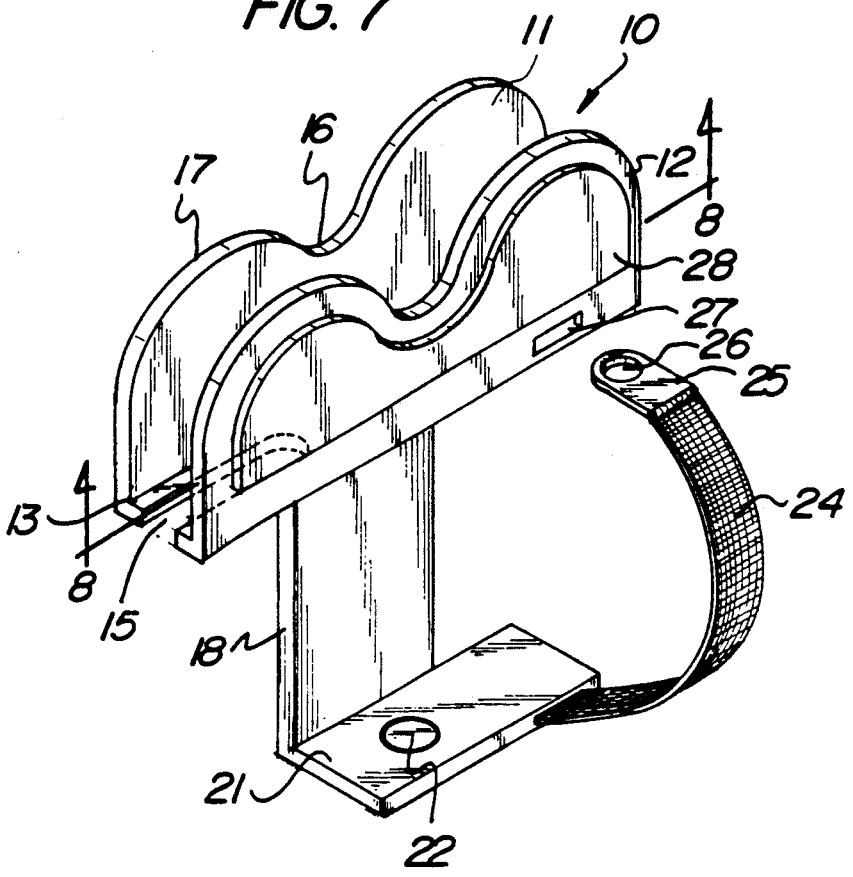
FIG. 7 is an elevational view in perspective showing a third preferred embodiment of the padlock protector of the invention.
Figure 8:
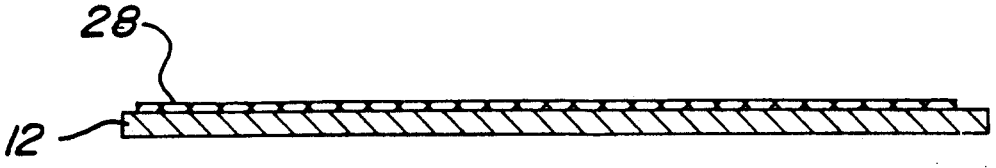
FIG. 8 is a cross-sectional view taken along line 8—8 of FIG. 7.

Further alternatively preferred embodiments of this invention are illustrated in FIGS. 3 to 8. As shown in FIGS. 3, 6 and 7, the padlock protector may further include an elongated front section which extends from the top 4 of the padlock 1 to the bottom 19 of the padlock 1. This elongated front 18 is attached at its bottom end 20 to a lower section which abuts against the bottom 19 of the padlock 1. This lower section 21 is provided with a spring-loaded dust cover 22 which fits over the keyhole (not shown) of the padlock 1. This dust cover serves to protect the keyhole against the elements, such as dust and water, and thereby extends the length of usefulness of the padlock 1. As portrayed in FIG. 5, the keyhole cover 22 may be fitted with a rubber seal 23 for additional protection of the keyhole. In this preferred embodiment, the bottom 21 of the padlock protector 10 is equipped with a strap 24 which is made of braided steel or tough plastic. The strap 24 contains at the distal end a metal tip 25 which contains a hole 26 of such size and shape as to fit around the shackle 5. In this embodiment, the back 12, of the padlock protector 10 is provided with a slot 27 which allows the metal tip 25 of the strap 24 to pass and engage the vertical shaft of the padlock 1 which clears the body of the padlock 1 when the padlock 1 is open. This provides added security to the padlock protector 10 as it ensures that the padlock protector 10 cannot be moved upwardly to expose the vertical shafts of the shackle 5.

An added feature of this invention is the presence of a magnet 28 fixedly attached to the back 12 of the padlock protector 10. This provides the padlock protector with the capacity to be easily and conveniently stored while the padlock 1 is separated from the latch.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. A padlock protector comprising:

a front, a back and a bottom; the front and the back being he same size and shape, the front and back having low center sections and raised lateral sections such that, when the padlock protector is placed upon a padlock having a top, a bottom, a front, a back, two sides, and a U-shaped shackle engageable with said padlock top, said shackle being made up of two vertical shafts and a curved central connector, the low center section will allow the shackle to engage a latch and the raised lateral sections will at least substantially cover the two vertical shafts of the shackle; said bottom having a hole of such size and shape as to allow one of the vertical shafts to pass through and having a slot of such size and shape extending along the bottom as to allow the other vertical shaft to pass through, said bottom being spaced below the lowest point of said low center sections of said front and said back wherein the front, back and bottom define a U-shaped perpendicular to the plane of the U-shape defined by said shackle, said bottom defining a distal end wall joining said front and said back and having first and second opposed edges orthogonally extending between said front and said back such that said distal end wall will engage said top of said padlock, said hole in said distal end wall being located intermedially of said first and second edges, said slot in said distal end wall having one end longitudinally spaced from said hole and having its opposed end intercepting said first edge of said distal end wall to provide an opening for said slot adapted to slidingly receive the two vertical shafts of said shackle therein whereby one of said vertical shafts may be inserted into said hole located intermedially of said distal end wall after said shackle is slidingly received within said slot.

2. The padlock protector of claim 1 which further comprises:

an elongated front section which is of such size and shape as to extend from the top of the padlock to the bottom of the padlock, a lower section continuing from the elongated front section and being of such size and shape as to extend substantially from the front of the padlock to the back of the padlock, a strap being attached at one end to the lower section of the padlock protector and having a hole in the other end of such size and shape as to allow the vertical shaft of the shackle to pass through, said strap being of such length as to extend from the lower section to the vertical shaft of the shackle, and the back of the padlock protector having an opening of such size and shape as to allow the passage of the strap.

3. The padlock protector of claim 2 wherein the strap is made of braided steel.

4. The padlock protector of claim 3 wherein a magnet is attached to the back in such a way as to allow the padlock protector to be held by a metal surface.

5. The padlock protector of claim 4 wherein the lower section has a hole and a cover over the hole.

6. The invention of claim 1 wherein said padlock protector has a length greater than the side-to-side measurement of the padlock.

* * * * *